US009101191B2

(12) United States Patent
Box et al.

(10) Patent No.: US 9,101,191 B2
(45) Date of Patent: Aug. 11, 2015

(54) PIVOTABLE KEY WITH REINFORCED POSITION LATCHING FOR ACTUATING A LOCK

(75) Inventors: Benoit Box, Parmain (FR); Thierry Acas, Fresne Leguillon (FR); Didler Pozzi, Ermont (FR); Jean-Michel Rieu, Sartrouville (FR); Fabrice Echasseriau, Colombes (FR)

(73) Assignee: Johnson Controls Technology Company, Holland, MI (US)

( * ) Notice: Subject to any disclaimer, the term of this patent is extended or adjusted under 35 U.S.C. 154(b) by 690 days.

(21) Appl. No.: 12/738,631

(22) PCT Filed: Oct. 11, 2008

(86) PCT No.: PCT/EP2008/008603

§ 371 (c)(1),
(2), (4) Date: Oct. 5, 2011

(87) PCT Pub. No.: WO2009/049839

PCT Pub. Date: Apr. 23, 2009

(65) Prior Publication Data

US 2012/0060572 A1 Mar. 15, 2012

(30) Foreign Application Priority Data

Oct. 19, 2007 (DE) ..... 10 2007 050 542
Apr. 21, 2008 (FR) ..... 08 02199

(51) Int. Cl.
*A44B 15/00* (2006.01)
*A45C 11/32* (2006.01)
*E05B 19/04* (2006.01)

(52) U.S. Cl.
CPC ..... *A45C 11/324* (2013.01); *E05B 19/043* (2013.01); *A44B 15/00* (2013.01)

(58) Field of Classification Search
CPC .... A44B 15/00; A44B 15/005; A45C 11/323; A45C 11/324; A45C 11/328
USPC ..... 70/395–397, 399, 408, 456 R, 459
See application file for complete search history.

(56) References Cited

U.S. PATENT DOCUMENTS 2,822,684 A * 2/1958 Ray ..... 70/456 R
4,660,397 A * 4/1987 Girimont ..... 70/456 R (Continued)

FOREIGN PATENT DOCUMENTS

EP 1 063 374 B1 12/2000
EP 1 526 232 B1 4/2005
WO WO 01/48342 A1 7/2001

OTHER PUBLICATIONS

International Search Report received in corresponding International Application No. PCT/EP2008/008603.

*Primary Examiner* — Christopher Boswell
(74) *Attorney, Agent, or Firm* — Foley & Lardner LLP

(57) ABSTRACT

A key (1) having one end (6) secured to a yoke (7) mounted in a casing (2) to turn between a position in which the key is retracted inside the casing and a position in which the key is extended, and a control pushbutton (17) mounted in the yoke to be constrained to pivot therewith, and to slide between an extended position for blocking the yoke in which the pushbutton possesses at least one stud (25) received in a notch (26) of a portion of the casing, and a pushed-in position for releasing the yoke to pivot, in which position the stud escapes from the notch, a spring (18) being interposed between the casing and the control pushbutton to urge the yoke resiliently towards the extended position and the control pushbutton towards its blocking position, the notch being formed in a washer (13) that is fitted in said portion of the casing, and the washer being harder than the casing.

16 Claims, 2 Drawing Sheets

(56) References Cited

U.S. PATENT DOCUMENTS

| | | | | |
|---|---|---|---|---|
| 4,888,970 | A * | 12/1989 | Kinzler et al. | 70/456 R |
| 6,499,326 | B1 * | 12/2002 | Heussner | 70/399 |
| 6,691,539 | B2 * | 2/2004 | Jacob et al. | 70/408 |
| 6,705,141 | B1 * | 3/2004 | Jacob et al. | 70/408 |
| 7,055,352 | B2 * | 6/2006 | Meyerson et al. | 70/456 R |
| 7,370,501 | B2 * | 5/2008 | Miyata et al. | 70/395 |
| 7,726,161 | B2 * | 6/2010 | Canard et al. | 70/456 R |
| 8,225,633 | B2 * | 7/2012 | Luo et al. | 70/456 R |
| 8,479,546 | B2 * | 7/2013 | Delande et al. | 70/456 R |
| 8,763,434 | B2 * | 7/2014 | David et al. | 70/456 R |
| 2005/0103070 | A1 * | 5/2005 | Meyerson et al. | 70/456 R |
| 2007/0062229 | A1 * | 3/2007 | Miyata et al. | 70/408 |
| 2007/0220936 | A1 * | 9/2007 | Miyata et al. | 70/408 |
| 2009/0217722 | A1 * | 9/2009 | Luo et al. | 70/459 |
| 2011/0030430 | A1 * | 2/2011 | Gueble | 70/396 |

* cited by examiner

PIVOTABLE KEY WITH REINFORCED POSITION LATCHING FOR ACTUATING A LOCK

The present invention relates to a key suitable for use, for example, for actuating the locks of motor vehicles.

CROSS-REFERENCE TO RELATED APPLICATIONS

This application is a National Stage application of PCT/EP2008/008603, filed Oct. 11, 2008, which claims the priority of German Patent Application No. 10 2007 050 542.8, filed Oct. 19, 2007 and France Patent Application No. 08 02199, filed Apr. 21, 2008. The foregoing applications are incorporated by reference herein in their entirety.

BACKGROUND OF THE INVENTION

There exist keys that have one end secured to a yoke that is mounted between two cheeks of a casing to turn about a pivot axis between a position in which the key is retracted inside the casing and a position in which the key is extended. A control pushbutton is mounted in the yoke so as to be constrained to pivot therewith, and so as to slide between an extended position for blocking the yoke, in which position the pushbutton has studs received in notches of the casing that are positioned to correspond with each of the positions of the yoke, and a pushed-in position for releasing pivoting of the yoke, in which position the studs are disengaged from the notches. A spring is interposed between the casing and the control pushbutton to urge the yoke resiliently into its extended position and the control pushbutton into its blocking position.

The casing is generally made of a plastics material while the pushbutton is made of metal. It often happens that the casing includes opposite from the yoke an orifice for passing a keyring.

OBJECT OF THE INVENTION

It has been found that the effectiveness with which the key is held in position runs the risk of being lost over time because of the pivot forces exerted on the key or the casing while the key is blocked in the extended position. Thus, while the key in its extended position is engaged in a lock, and if the keyring is heavily loaded, then the studs of the pushbutton exert large stresses against the walls of the notches, which tend to become flattened, leading to the notches becoming flared and thus encouraging the studs to escape.

To remedy that problem, one possible solution might be to increase the area of the contacting surfaces in order to distribute stresses better. Nevertheless, that would increase the size of the casing. Another solution might be to increase the stiffness of the spring so as to prevent untimely escape of the studs from the notches, but that would make the pushbutton more difficult to operate.

An object of the invention is to provide means for blocking the yoke in position, which means are more reliable, while also remaining simple.

BRIEF DESCRIPTION OF THE INVENTION

To this end, the invention provides a key having one end secured to a yoke mounted in a casing to turn between a position in which the key is retracted inside the casing and a position in which the key is extended, and a control pushbutton mounted in the yoke to be constrained to pivot therewith, and to slide between an extended position for blocking the yoke in which the pushbutton possesses at least one stud received in a notch of a portion of the casing, and a pushed-in position for releasing the yoke to pivot, in which position the stud escapes from the notch, a spring being interposed between the casing and the control pushbutton to urge the yoke resiliently towards the extended position and the control pushbutton towards its blocking position, the notch being provided in a washer that is fitted in said portion of the casing, and the washer being harder than the casing.

The term "washer" is used herein in any part having an opening enabling it to receive the pushbutton. Thus, the washer is mechanically stronger than the casing and may be made of a material that is as strong as the material from which the pushbutton is made. The yoke is thus blocked in particularly secure manner that is little subject to wear.

In a first particular embodiment, the washer is inserted by force in a setback of the first cheek.

In a second particular embodiment, said portion of the casing is overmolded on the washer.

In a third particular embodiment, said portion of the casing includes at least one zone that has been deformed to hold the washer in position.

Preferably, the washer includes means for preventing it from turning relative to the first cheek, these means having an outline that is not circular and advantageously at least one projection projecting outwards to bear against a surface of the casing.

The non-circular outline may extend over all or part of the thickness of the washer. The projections make it possible to benefit from a lever arm effect and to have a relatively large area over which to distribute the stresses that the washer exerts on the casing when the casing is urged to turn relative to the key.

Other characteristics and advantages appear on reading the following description of a particular, non-limiting embodiment of the invention.

BRIEF DESCRIPTION OF THE DRAWINGS

Reference is made to the accompanying drawings, in which.

DETAILED DESCRIPTION OF THE INVENTION

The key in accordance with the invention is described herein as a device for actuating locks such as those of a motor vehicle. In particular, the key is suitable for use in locking and unlocking the doors, the trunk, and the steering column, and also for actuating the ignition.

Figure 1:
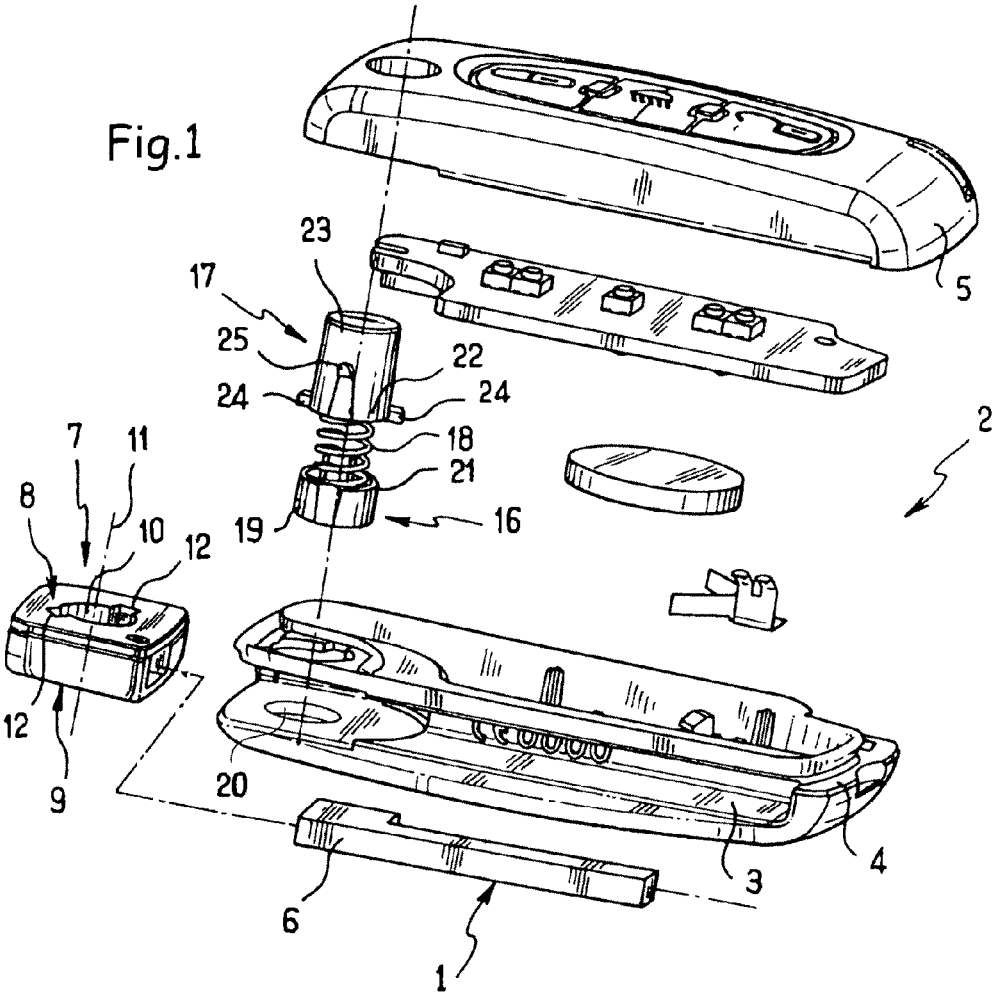
FIG. 1 is an exploded perspective view of a key in accordance with the invention.
Figure 2:
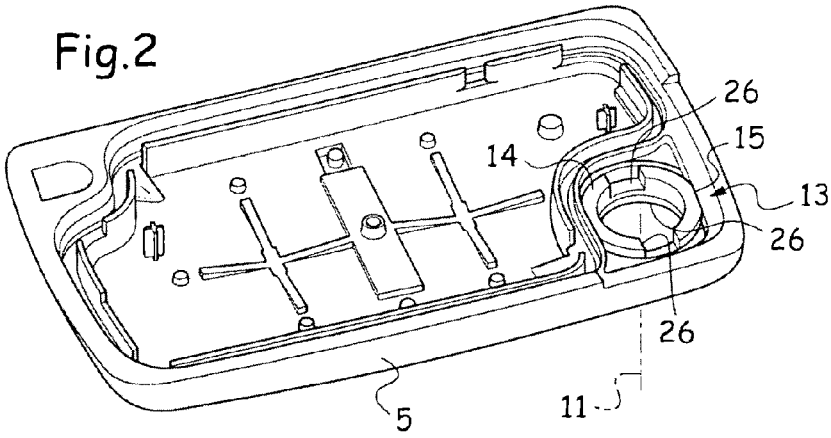
FIG. 2 is a perspective view of a portion of the casing of the key, this portion of the casing being fitted with a washer in accordance with the invention.

With reference to FIGS. 1 to 2, the key, given overall reference 1, is mounted in a casing 2 to pivot between a position in which it is retracted in a lateral setback 3 of the casing 2 and an extended position in which the key 1 extends at 180° relative to its retracted position. In this example, the casing 2 is in the form of a receptacle 4 closed by a cover 5 and it contains an electronic remote control module arranged in known manner to actuate a centralized locking and unlocking device remotely for locking and unlocking the doors of the motor vehicle. The electronic control module may also be arranged to activate and deactivate an alarm, to switch the vehicle headlights on and off, . . . .

In this example, the receptacle 4 and the cover 5 are made by injection-molding a thermoplastic material.

The cover 5 possesses an opening 27 with a central axis 11 that is perpendicular to the longitudinal axis of the key 1 and that coincides with the pivot axis of the key 1.

A washer 13 is received in a setback 14 formed in the cover 5 coaxially around the opening 27 in the cover 5 of the casing 2. Notches 26 extending at 180° relative to each other are formed in the thickness of the washer 13 and they open out into an inside circumference of the washer 13 and into the face of the washer 13 that faces towards the receptacle 4 (the notches 26 are of a height that is smaller than the thickness of the washer 13). The washer 13 has an outline that is not circular, and in this example that is provided with a flat 15 that extends in contact with a plane face of the setback 14 to prevent the washer 13 from turning relative to the cover 5.

The washer 14 is made of metal in this example, and more particularly out of a zinc-based alloy including, in particular, aluminum, such as the alloy sold under the trademark Zamak. The washer 13 is made by turning, cold heading, or cutting and stamping. The cover 5 in this example is overmolded on the washer 13. The washer 13 is thus harder than the casing 2 made of thermoplastic material. More generally, the washer 13 is mechanically stronger than the casing 2.

The key 1 has one end 6 fastened in a yoke given overall reference 7 and received between two parallel cheeks of the casing at one end of the lateral setback 3 in order to be able to pivot between the extended position and the retracted position of the key 1.

The yoke 7 possesses two outside faces 8, 9 that are parallel and face in opposite directions. The yoke 7 has a bore 10 of axis that coincides with the central axis 11, which is perpendicular to the outside faces 8, 9. The bore 10 presents a cross-section that is circular and it opens out into the outside faces 8, 9.

The bore 10 in the yoke 7 receives a hinge element given overall reference 16 and a control pushbutton given overall reference 17, with a spring 18 extending between them.

The hinge element 16 has an externally cylindrical shape of circular outline and possesses an end 19 that is received in a cavity 20 at the end of the lateral setback 3 receiving the yoke 7 and an opposite end 21 pivotally received in the bore 10 in the yoke 7. The cavity 20 and the end 19 of the hinge element 16 possess portions in relief of complementary shape that prevent the hinge element 16 from turning relative to the casing 2. The end 19 may thus for example include flats in contact with corresponding plane surfaces of the cavity 20, or an off-center indentation receiving a corresponding portion in relief projecting from the cavity 20. The end 21 has an outside shape that is substantially cylindrical and of circular section.

The control pushbutton 17 has an outside surface that is circularly cylindrical and it possesses one end portion 22 received in the bore 10 and an opposite end portion 23 projecting from the bore 10 and the cover 5 by passing through the opening 27 therein. Two studs 24 that are angularly offset relative to each other by 170° project from the end portion 22 and are received in grooves 12 formed in known manner in the bore 10 so as to have a bayonet shape in order to allow the pushbutton to slide between a position in which it prevents the yoke 7 from pivoting and a position in which it releases pivoting of the yoke 7.

In the blocking position, two studs 25 projecting from the end portion 23 and set back from the terminal space thereof are engaged in the two notches 26.

In the position releasing the yoke 7 for pivoting, the control pushbutton 17 is pushed in so that the studs 25 are disengaged from the notches 26.

The hinge element 16 and the control pushbutton 17 define a hinge and pivot axis for the yoke 7 relative to the casing 2. This hinge axis coincides with the central axis 11.

The spring 18 has ends that are prevented from turning in the hinge element 16 and in the control pushbutton 17. In this example, the control pushbutton 17 has a slot 27 receiving the corresponding end of the spring 18 to prevent said end from turning relative to the pushbutton. The spring 18 is a helical spring arranged to work in compression so as to tend to return the control pushbutton 17 into its blocking position. In addition, when the yoke 7 is in the retracted position, the spring 18 has been subjected to twisting through at least 180° relative to its rest state. The spring 18 is thus also arranged to work in twisting so as to tend to keep the studs 24 pressed against the flanks of the grooves 12, and thus to turn the yoke 7 into the position in which the key 1 is extended.

It should be observed that, in operation, the control pushbutton 17 in its blocking position serves both to hold the yoke 7 in its position with the key 1 extended and in its position with the key 1 retracted. If the notches 26 are defined laterally by flanks parallel to the sliding direction, it is necessary to push the control pushbutton 17 into its release position in order to move the key 1 from its extended position to its retracted position, or vice versa.

Figure 3:
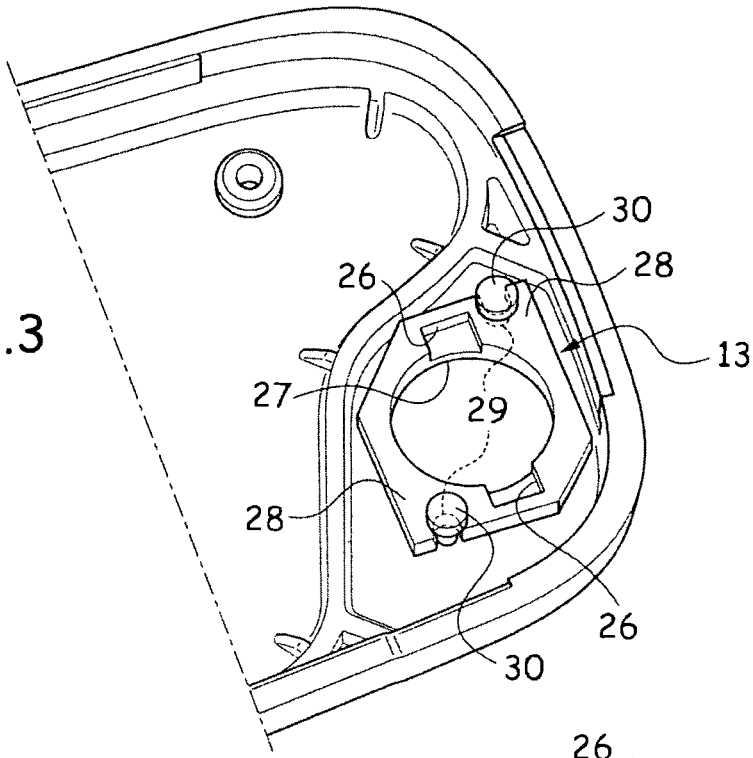
FIG. 3 is a fragmentary perspective view of a first embodiment variant of the washer.

In the variant of FIG. 3, the notches 26 in the washer 13 are of a height that is equal to the thickness of the washer 13 such that the notches 26 open out into both faces of the washer 13, thereby facilitating fabrication, in particular by cutting out and stamping.

The washer 13 possesses two lateral projections 28 that project out from the washer 13 and each of which is provided with a notch 29. The portion of the cover 5 receiving the washer 13 possesses a lateral surface extending in register with at least one of the lateral projections 28 in such a manner that the lateral projection 28 comes into abutment against said surface of the cover 5 to oppose relative pivoting of the washer 13 and the cover 5. Each notch 29 receives a stud 30 projecting from the inside surface of the cover 5. Each stud 30 has a head that projects from the washer 13 and that is deformed while hot (in this example flattened) so as to press the washer 13 against the inside surface of the cover 5.

In a variant, the studs 30 may be engaged as force-fits in orifices in the washer 13.

Figure 4:
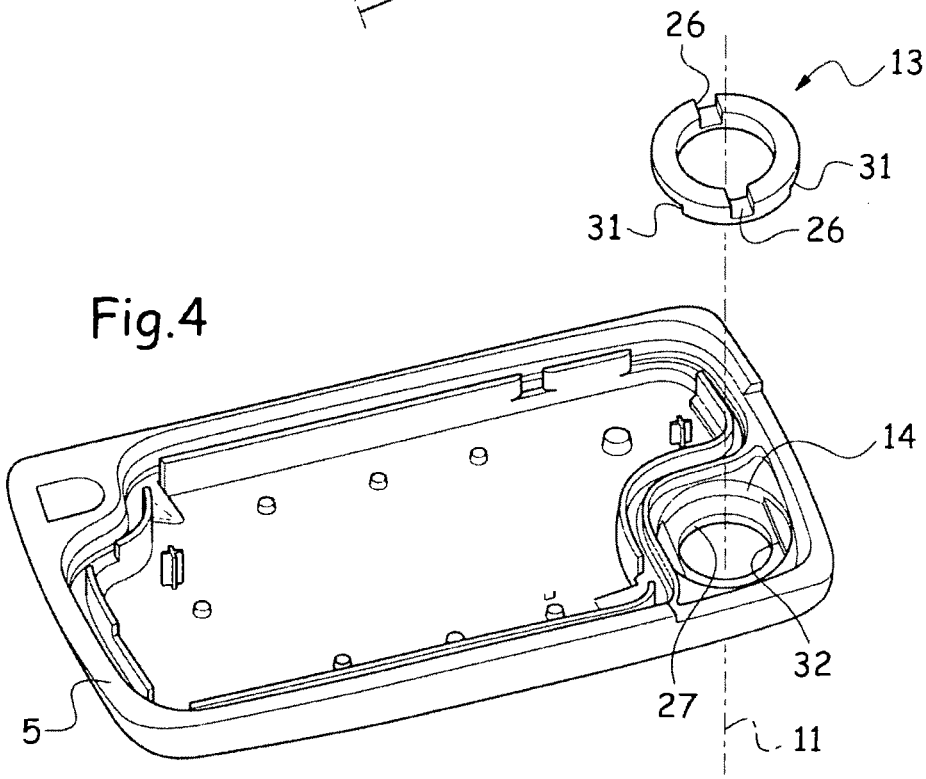
FIG. 4 is a fragmentary perspective view of the portion of the casing fitted with a second variant of the washer.

In the variant of FIG. 4, the washer 13 is forcibly inserted in the setback 14, with the setback 14 presenting dimensions perpendicularly relative to the central axis 11 that are smaller than the outside dimensions of the washer 13, so that the washer 13 is held in the setback by elastic deformation. To make forced insertion easier, entry chamfers are provided on the setback and the washer 13.

The washer 13 possesses peripheral steps 31 for cooperating with portions in relief 32 of complementary shape in the setback 14 for the purpose of preventing the washer from turning relative to the cover 5. In this example, the steps 31 occupy only a fraction of the thickness of the washer 13, beside the end wall of the setback 14, and they are in an arrangement that is symmetrical about a diametral plane of the washer 13.

In another variant, it is possible to fasten the washer 13 to the cover 5 by ultrasound, friction, or induction welding, by adhesive, or by any other fastening technique that serves to prevent the washer 13 from turning relative to the cover 5. The washer may present an outside surface having portions in relief, such as knurling, in order to facilitate keeping it in position.

The washer 13 may be fastened in a setback or it may be fastened directly to the wall of the cover.

Naturally, the invention is not limited of the embodiment described and embodiment variants may be applied thereto without going beyond the ambit of the invention as defined by the claims.

In a variant, if it is desired to be able to move the key 1 from its extended position to its retracted position without it being necessary to actuate the control pushbutton 17, the flanks of the notches 26 that are beside the retracted position (i.e. the flanks against which the studs 25 come into abutment when an attempt is made to move the key 1 from its extended position towards its retracted position) may be inclined so as to co-operate with the stud 25 and form a cam that slides so as to move the control pushbutton 17 into its release position.

In addition, the casing 2 may be of a shape other than that shown, for example it may be cylindrical with the retracted and extended positions of the key being angularly offset from each other by an angle that is not equal to 180°, e.g. angle of 90° or of 120°.

In addition, the hinge element may be made integrally with the casing.

It is also possible to provide only one notch or to provide more than two. The notches are made over a height that is less than the thickness of the washer or over the entire thickness of the washer so as to open out into both faces of the washer.

The washer may be made of one or more parts and it may be made of a metal or of any other material that is mechanically stronger than the portion of the casing to which it is fastened.

What is claimed is:

1. A key assembly comprising:

a casing including a portion having a notch;

a yoke mounted in the casing;

a key having one end secured to the yoke to turn between a position in which the key is retracted inside the casing and a position in which the key is extended;

a control pushbutton mounted in the yoke to be constrained to pivot therewith, and to slide between an extended blocking position for blocking the yoke in which the control pushbutton includes at least one stud received in the notch, and a pushed-in position for releasing the yoke to pivot, in which position the stud escapes from the notch; and a spring interposed between the casing and the control pushbutton to urge the yoke resiliently towards the extended position and the control pushbutton towards its blocking position, wherein the notch is formed in a washer that is fastened in the portion of the casing, wherein the washer is harder than the casing, wherein the washer includes an anti-rotation feature to prevent rotation of the washer relative to the casing, the anti-rotation feature having an outline that is not circular, wherein the washer is inserted by force into a setback of the casing, wherein the portion of the casing includes at least one stud that has been deformed to hold the washer in position, wherein the portion of the casing is made of thermoplastic material and the stud of the portion of the casing has been deformed while hot, and wherein the washer includes two lateral projections that project from the washer and each projection is provided with a notch, and the portion of the casing receiving the washer includes a lateral surface that extends with at least one projection such that the projection is configured to abut the surface to oppose relative rotation between the washer and the casing.

2. A key according to claim 1, wherein the washer includes at least one projection projecting towards the outside to bear against a surface of the casing.

3. A key according to claim 1, wherein the washer is made of metal.

4. A key according to claim 3, wherein the metal is a zinc alloy.

5. A key according to claim 1, wherein the casing comprises a receptacle and a cover, and the washer is fastened to the cover.

6. A key according to claim 1, wherein the notch opens out into two opposite faces of the washer.

7. A key according to claim 1, wherein the washer includes peripheral steps for cooperating with sections in relief of complimentary shape of the portion of the casing to prevent rotation of the washer relative to the casing.

8. A key assembly comprising:

a casing including a portion having a notch;

a yoke mounted in the casing;

a key having one end secured to the yoke to turn between a position in which the key is retracted inside the casing and a position in which the key is extended;

a control pushbutton mounted in the yoke to be constrained to pivot therewith, and to slide between an extended blocking position for blocking the yoke in which the control pushbutton includes at least one stud received in the notch, and a pushed-in position for releasing the yoke to pivot, in which position the stud escapes from the notch; and a spring interposed between the casing and the control pushbutton to urge the yoke resiliently towards the extended position and the control pushbutton towards its blocking position, wherein the notch is formed in a washer that is fastened in the portion of the casing, wherein the washer is harder than the casing, wherein the washer includes an anti-rotation feature to prevent rotation of the washer relative to the casing, the anti-rotation feature having an outline that is not circular, wherein the washer is inserted by force in a setback of the casing, and wherein the washer includes peripheral steps for cooperating with sections in relief of complimentary shape of the portion of the casing to prevent rotation of the washer relative to the casing.

9. A key according to claim 8, wherein the portion of the casing includes at least one stud that has been deformed to hold the washer in position.

10. A key according to claim 9, wherein the portion of the casing is made of thermoplastic material and the stud of the portion of the casing has been deformed while hot.

11. A key according to claim 8, wherein the washer includes at least one projection projecting towards the outside to bear against a surface of the casing.

12. A key according to claim 8, wherein the washer is made of metal.

13. A key according to claim 12, wherein the metal is a zinc alloy.

14. A key according to claim 8, wherein the casing comprises a receptacle and a cover, and the washer is fastened to the cover.

15. A key according to claim 8, wherein the notch opens out into two opposite faces of the washer.

16. A key according to claim 8, wherein the washer includes two lateral projections that project from the washer and each projection is provided with a notch, and the portion of the casing receiving the washer includes a lateral surface that extends with at least one projection such that the projection is configured to abut the surface to oppose relative rotation between the washer and the casing.

* * * * *